United States Patent [19]

Mapes et al.

[11] Patent Number: 4,966,347

[45] Date of Patent: Oct. 30, 1990

[54] OUTBOARD MOTOR RETAINER

[75] Inventors: Charles W. Mapes; Richard H. Snyder, both of Oshkosh, Wis.

[73] Assignee: Brunswick Corporation, Skokie, Ill.

[21] Appl. No.: 423,664

[22] Filed: Oct. 18, 1989

Related U.S. Application Data

[63] Continuation of Ser. No. 241,629, Sep. 8, 1988, abandoned.

[51] Int. Cl.[5] ..... F16M 13/00

[52] U.S. Cl. ..... 248/643; 248/300

[58] Field of Search ..... 248/640, 641, 642, 643, 248/351, 300; 440/900, 53, 55

[56] References Cited

U.S. PATENT DOCUMENTS

| | | | |
|---|---|---|---|
| 2,592,772 | 4/1952 | Wardius | 248/642 X |
| 2,600,095 | 6/1952 | Consolo et al. | 248/642 X |
| 2,704,933 | 3/1955 | McMullan | 248/642 X |
| 2,858,690 | 11/1958 | Sanderson et al. | 248/640 X |
| 2,930,218 | 3/1960 | Ashmore | 248/640 X |
| 3,056,977 | 10/1962 | McGuire | 248/640 X |
| 3,943,877 | 3/1976 | Kemp | 248/642 X |
| 4,228,983 | 10/1980 | Bowman, Jr. | 248/553 |

OTHER PUBLICATIONS

"Marine and Sailing Accessories", Griffin's Marine Inc., 1987, p. 595.

*Primary Examiner*—Karen J. Chotkowski

*Attorney, Agent, or Firm*—Andrus, Sceales, Starke and Sawall

[57] ABSTRACT

A retainer for a transom-mounted outboard boat motor is mounted on the inside face of the transom generally surrounding the area where the clamping thumb screws of the motor mounting bracket engage the transom. The retainer includes a retaining lip defining an undercut groove which will engage the pads on the clamping thumb screws should the motor shift inadvertently out of position and prevent horizontal sliding or vertical tilting which may result in loss of the motor. The retainer is easily attached to the boat transom and offers no significant interference to attachment or removal of the motor.

7 Claims, 2 Drawing Sheets

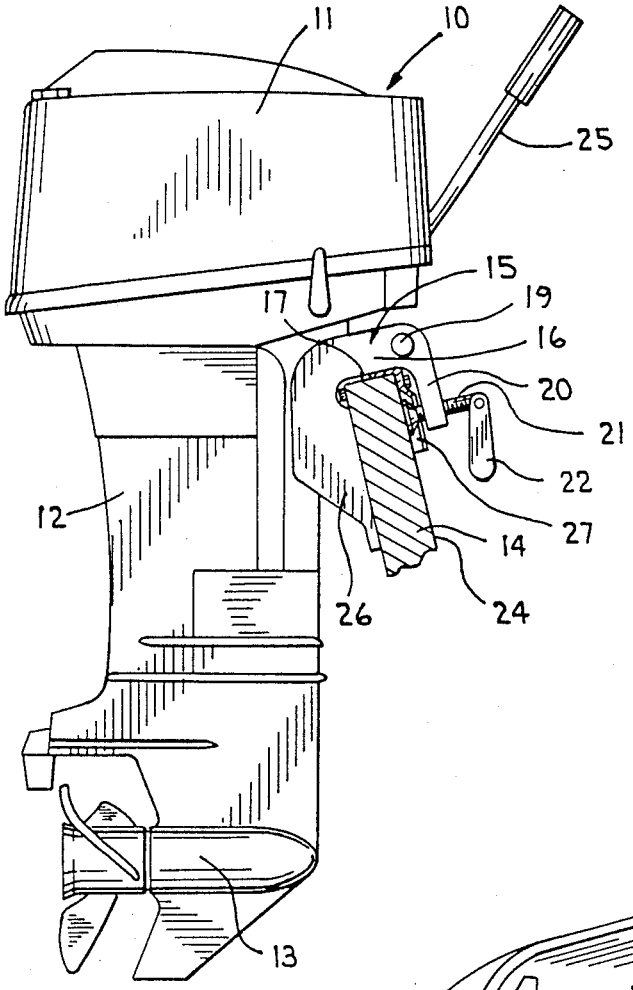
FIG. 1
FIG. 2
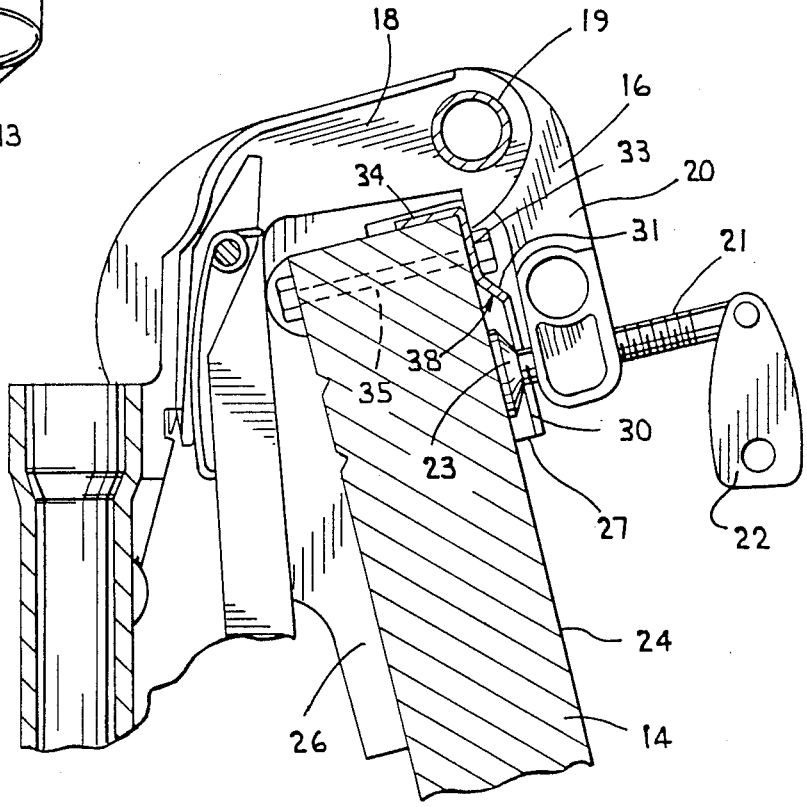

FIG. 3
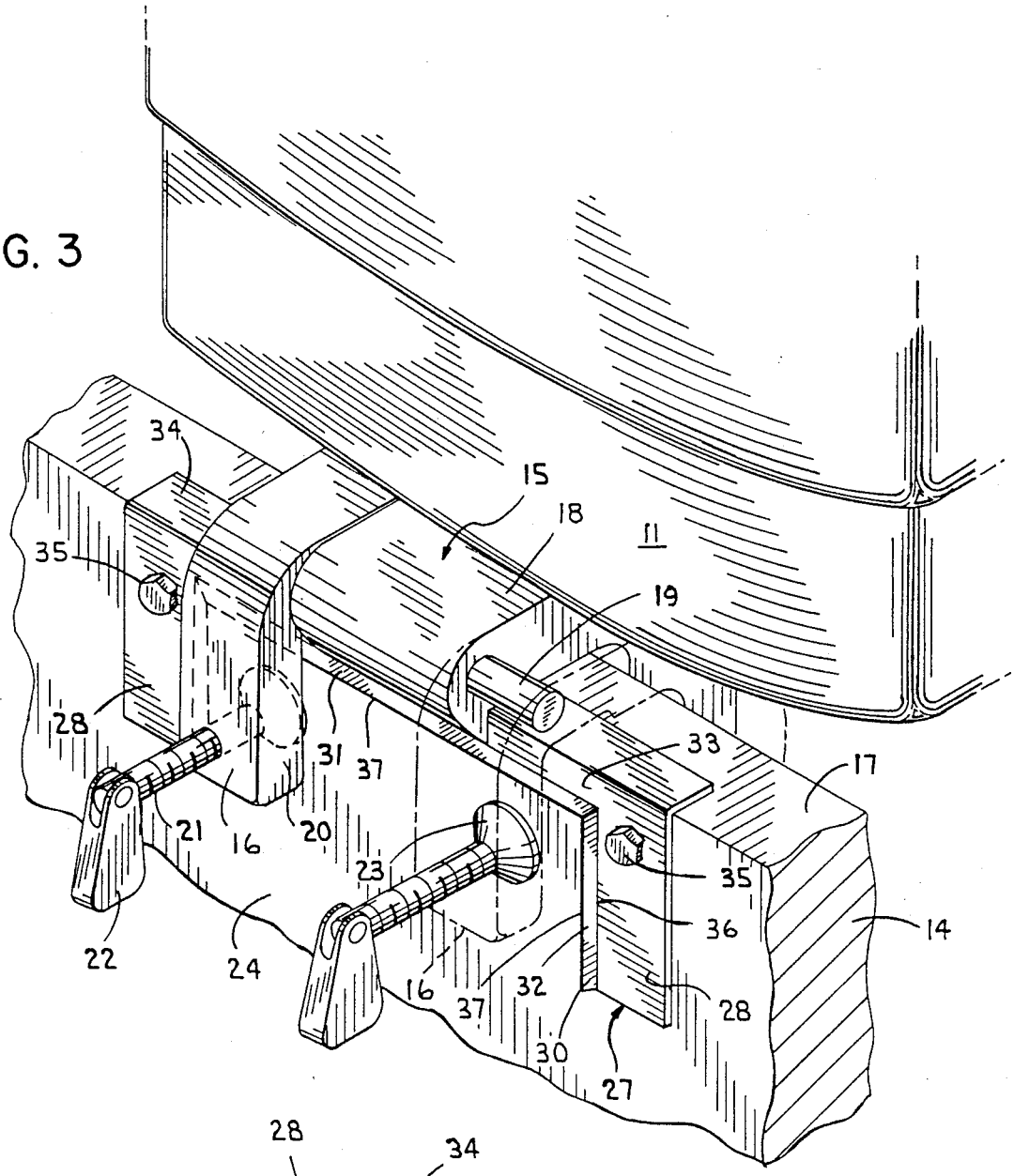
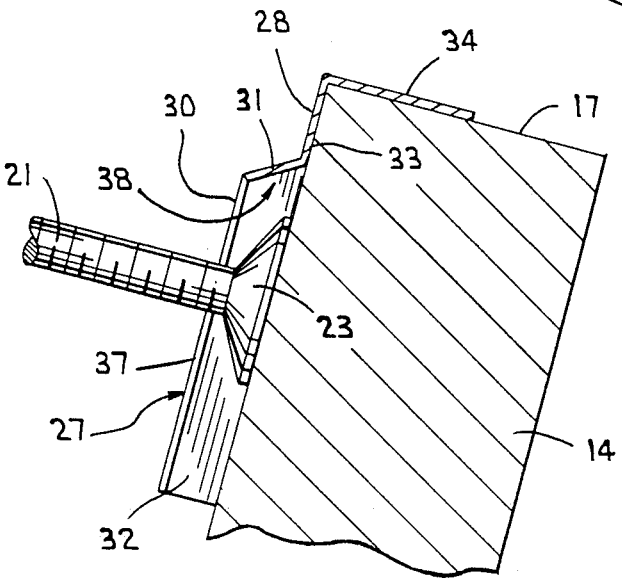
FIG. 4

OUTBOARD MOTOR RETAINER

This is a continuation of application Ser. No. 241,629, filed Sept. 9, 1988, now abandoned.

BACKGROUND OF THE INVENTION

The present invention relates to outboard boat motors of the type adapted to be mounted on the transom of a boat and, more particularly, to a retainer for preventing the motor from inadvertently moving or coming off the transom in the event the clamping screws are not properly tightened.

A typical outboard motor for a boat includes a transom bracket by which it is attached to the boat and about which the engine and drive unit may be pivoted about a horizontal axis extending laterally through the transom bracket. The transom bracket typically includes a pair of generaly U-shaped clamping members placed over the upper edge of the boat transom A manually operable thumb screw extends through the leg of each of the U-shaped members inside the boat and includes a clamping pad on the end of each for demountably clamping the transom bracket to the boat transom. Alternately, the legs of each of the generally U-shaped members may be interconnected with bolts extending through the transom, but this obviously results in an installation in which the motor is not easily removed from the boat With most smaller sized outboard motors which are hand operated by a tiller handle attached to the motor, most operators prefer to be able to readily demount and remove the motor from the boat transom. Therefore, the use of the thumb screw type of clamping assembly is more attractive. However, care must be taken to assure that the thumb screws are adequately tightened and that they do not work loose as a result of vibration or the like during the operation. Operation of an outboard motor with loosened thumb screw clamps may result in the motor sliding laterally along the transom or, in the worst case, the engine under certain conditions of drive unit thrust and steering angle may tilt upwardly on the transom and come completely off the boat. The obvious result is the loss of an outboard motor or, if the motor is chained or otherwise supplementally secured to the boat, the engine may still be submerged or the engine and/or the boat otherwise damaged.

In one prior art device, a plate is attached to the inside face of the transom and includes a horizontal laterally extending rib set at a height which will be just above the clamping pads on the thumb screws when the motor is clamped to the transom. The rib is intended to function to keep the transom bracket and the motor from tilting upwardly and off its mounting on the transom should the thumb screws be left or become untightened. Obviously, however, such a horizontal rib will not prevent a loosened outboard motor from sliding laterally along the transom and possibly beyond the extent of the protecting rib. Furthermore, sufficiently loosened thumb screws may result in a large enough gap such that the clamping pads will completely clear the rib and result in upward movement and possible loss of the motor.

It would be desirable, therefore, to have a means for more positively retaining the position of a transom-mounted outboard motor should the clamping thumb screws become loosened or be left untightened. Such a retaining means should be capable of preventing lateral movement of the motor along the transom and vertical movement of the motor upwardly and off of its mounting. It would also be desirable to have a retaining means which is of simple and inexpensive construction, easily attachable, and would not unreasonably interfere with mounting the motor to or detaching it from the boat transom using a conventional thumb screw type of clamping assembly. Finally, the retaining device should be widely adaptable for use on boats with varying transom constructions and with outboard motors of varying size.

SUMMARY OF THE INVENTION

The present invention is directed to an outboard motor retaining device which is especially adapted to help prevent the inadvertent movement or loss of an outboard motor of the type utilizing conventional thumb screw operated clamping members for mounting the motor to a boat transom.

The retainer includes a retaining lip which is attached to the inside face of the transom and disposed to generally circumscribe the areas above and on either side of the engagement between the clamping members on the outboard motor transom bracket and the transom. The retaining lip is further disposed to diverge outwardly from the face of the transom and toward the transom-engaging ends of the clamping members and to terminate in an edge which is adapted to overlie a portion of the clamping members, such as the edges of the clamping pads, if they are displaced from their normally clamped positions and to thereby prevent further displacement of the clamping members (and the outboard motor) in either a lateral or upward direction. The retaining lip preferably comprises a three sided generally rectangular construction including a horizontal upper portion and integral lateral portions extending downwardly from each end of the upper portion. Each of the three portions of the retaining lip is disposed at an acute angle (e.g., 60°) with respect to the face of the transom to define therewith a generally V-shaped notch adapted to be engaged by and capture the edges of the clamping pads on the thumb screws should loosened screws result in lateral or vertical movement of the motor.

The base of the retaining lip adjacent the transom includes an integral mounting flange adapted to lie flat against the transom for attachment therto, as with bolts or other suitable mounting means. The upper portion of the mounting flange may include an integral retaining lip extending perpendicularly from the mounting flange and adapted to engage and be flat atop the upper edge of the transom.

Preferably, the edge of the retaining lip extends from the face of the transom a distance less than the distance between the transom face and the faces of the clamping pads when the thumb screws carrying the pads are fully withdrawn from clamping engagement. In this manner, the motor retainer will not inhibit or substantially interfere with attaching or detaching the motor to or from the transom.

BRIEF DESCRIPTION OF THE DRAWINGS

The drawings illustrate the best mode presently contemplated of carrying out the invention.

FIG. 1 is a side elevation view of a transommounted outboard motor showing the retainer of the present invention attached to the transom.

FIG. 2 is an enlarged portion of the FIG. 1 view, in partial section, showing more detail of the retainer of the present invention and the transom bracket of the outboard motor with which it is adapted to be used.

FIG. 3 is a perspective view looking generally aft of the boat and showing the retainer of the present invention with a conventional motor mounting assembly.

FIG. 4 is an enlarged sectional view through the transom and retainer showing details of the relationship between the retainer lip and the clamping pad of the mounting bracket.

DETAILED DESCRIPTION OF THE PREFERRED EMBODIMENT

A conventional outboard motor 10 includes an engine mounted inside a cowl 11 and a downwardly depending drive unit 12 including a lower gear case and propeller unit 13. The motor 10 is mounted to a boat transom 14 by means of a transom bracket assembly 15. The transom bracket assembly includes a pair of laterally spaced generally U-shaped clamping brackets 16 adapted to slide over the upper edge 17 of the transom 14. A swivel bracket 18 is pivotally attached between the clamping brackets 16 by a pivot tube 19 such that the swivel bracket 18 may rotate about a generally horizontal axis with respect to the clamping brackets and the boat transom. The motor 10 is attached to the swivel bracket 18 for horizontal tilting rotation therewith about the axis of the pivot tube 19. As is conventional construction, the motor is also mounted for pivotal steering movement about a generally vertical axis on the swivel bracket 18.

The forward leg 20 of each clamping bracket 16 has threadably attached thereto a thumb screw 21 with a manually engagable turnbuckle 22 on the outer end a clamping pad 23 on the inner end. By turning the thumb screws and moving the clamping pads into engagement with the inside face 24 of the transom 14, the transom bracket assembly 15 and the attached motor 10 may be securely mounted to the boat. Conversely, the motor may be readily removed from the boat by loosening the thumb screws 21 and lifting the motor off the transom. Smaller outboard motors are typically manually operated by utilizing a hand tiller 25 to steer and tilt the motor, as well as to change gears, speed and direction. Typically, owners and operators of such outboard motors desire to have the ability to readily remove and remount the motor on the boat and are, therefore, reluctant to utilize a more permanent means of mounting, such as bolts extending through the transom and the aft legs 26 of the clamping brackets 16.

However, should the thumb screws 21 become sufficiently loose such that the clamping force is lost or substantially diminished, the propeller thrust of the operating motor along with the steering angle at which it is disposed may cause the motor to tilt in a sideways manner (i.e. rocking about one edge of the portion of a clamping bracket in engagement with the upper edge 17 of the transom), resulting in complete disengagement between the clamping brackets 16 and the transom 14. Short of complete loss of the motor, loose thumb screws may result in the motor sliding laterally along the transoms, an undesirable and potentially dangerous situation. The retainer 27 of the present invention has been found to be effective to prevent the loss of an outboard as a result of loose clamping screws under virtually all circumstances.

The retainer 27 is of a generally C-shaped construction and includes a 3-sided mounting flange 28. The inner peripheral edge of which is bent at an acute angle with respect to the plane of the mounting flange to form a retaining lip 30. The retaining lip includes a generally horizontal upper portion 31 and lateral portions 32 extending downwardly from each end of the upper portion 31. The top portion 33 of the mounting flange 28 integral with the upper portion 31 of the retaining lip includes a horizontally disposed positioning flange 34 extending perpendicular to the plane of the mounting flange 28 and in a direction opposite from the retaining lip 30. The retainer 27 is adapted to be attached to the transom 14 with the mounting flange 28 in contact with the inside face 24 of the transom and the positioning flange 34 resting on the upper edge 17 of the transom. The retainer is secured in its mounted position with a pair of mounting bolts 35 extending through the transom. The retainer is typically mounted at the center of the transom in a manner to generally bound the region where the clamping pads 23 on the thumb screws 21 typically engage the inside face of the transom 14 when the motor is mounted thereon.

Referring particularly to FIG. 3, the retaining lip 30 from the integral attachment of its base 36 to the mounting flange 28 diverges from the transom and extends toward the thumb screws on the clamping brackets 16. The retaining lip 30 terminates in a free inner edge which is spaced from the face of the transom by an amount greater than the thickness of the outer edge of the clamping pads 23. Because of the acute angle at which the upper portion 31 and each of the lateral portions 32 of the retaining lip are disposed with respect to the mounting flange 28 and transom face 24, each lip portion 31 and 32 defines a generally V-shaped groove into which the edges of the clamping pads 23 will slide if the transom bracket assembly is displaced from its normal clamped position. Thus, the retaining lip 30 not only provides a barrier to limit lateral and/or vertical movement of the motor, but displacement of the edges of the clamping pads 23 into the V-shaped grooves 38 will tend to prevent the clamping assembly from overriding the retainer.

In order that the outboard motor 10 may be readily mounted to and demounted from the transom with the retainer attached thereto in its operative position, the edge 37 of the retaining lip 30 must be disposed at a distance from the inside face 24 of the transom less than the distance between the face 24 and the clamping faces of the clamping pads 23 when the pads are fully withdrawn from clamping engagement. Thus, use of the retainer of the present invention does not inhibit or impede the usual mounting or removal of an outboard motor, except to require that the clamping thumb screws be substantially open to clear the edge 37 of the retaining lip 30.

The outboard motor retainer of the present invention has been found to be most effective in preventing the motor from sliding laterally and/or tilting up and off the boat transom under virtually all operating conditions, including those where the thumb screws are left untightened. One exception, however, may occur in a situation where the thumb screws are fully open (completely withdrawn) and the boat is operated in a tight turn under reverse throttle. In this situation, the tilting movement caused by the reverse propeller thrust may cause the loose clamping brackets 16 to tilt forwardly such that the edges of the clamping pads 23 will not engage the retaining lip 30 as the motor tilts up. Nevertheless, the retainer 27 provides a substantial improvement over known prior art devices without interfering with attachment or removal of the motor.

Various modes of carrying out the invention are contemplated as being within the scope of the following claims particularly pointing out and distinctly claiming the subject matter which is regarded as the invention.

We claim:

1. A retainer assembly for a transom-mounted outboard boat motor comprising, in combination:

a boat transom;

a motor transom bracket having transom-engaging clamping members including a pair of thumb screws threadably attached to the transom bracket, each screw having a clamping pad on one end including a clamping face adapted to engage the transom, said clamping pads being adjustable between a normally clamped position in engagement with the transom and an unclamped position disengaged from the transom;

a retaining lip attached to the transom and substantially completely surrounding the upper and lateral regions of engagement between the clamping pads and the transom;

said retaining lip having a generally horizontal upper portion and lateral portions extending downwardly from each end of said upper portion, said lateral portions spaced apart a distance greater than the maximum distance between said clamping pads, whereby the clamping pads are adjustable between said clamped and unclamped postions without engaging said lip; and, said retaining lip diverging along substantially the full length thereof from the transom toward the clamping pads, said lip and the adjacent face of the transom defining a groove large enough to receive and engage the edge of a clamping pad displaced from said normally clamped position and to prevent further displacement thereof in the lateral and upward directions.

2. The invention as set forth in claim 1 wherein said retaining lip includes a base opposite its free and edge of the lip and a mounting flange comprising an integral extension of the base and adapted to lie against and be attached to the inside face of the transom.

3. The invention as set forth in claim 2 including mounting means for attaching the retainer to the transom.

4. The invention as set forth in claim 3 wherein the mounting flange integral to the horizontal upper portion of the retaining lip includes an integral horizontally disposed positioning flange adapted to engage the upper edge of the transom.

5. The invention as set forth in claim 1 wherein the retainer is attached to the inside face of the transom.

6. The invention as set forth in claim 5 wherein the edge of the retaining lip extends from the inside face of the transom a distance less than the distance between said face and the clamping faces of the clamping pads when said pads are in the fully unclamped position.

7. The invention as set forth in claim 6 wherein the retaining lip is disposed at an acute angle to the face of the transom.

* * * * *

UNITED STATES PATENT AND TRADEMARK OFFICE

CERTIFICATE OF CORRECTION

PATENT NO. : 4,966,347

DATED : October 30, 1990

INVENTOR(S) : Charles W. Mapes et al

It is certified that error appears in the above-identified patent and that said Letters Patent is hereby corrected as shown below:

COLUMN 6

Claim 2, line 10, delete "its free and" and substitute --an--.

Signed and Sealed this

Twenty-first Day of April, 1992

*Attest:*

HARRY F. MANBECK, JR.

*Attesting Officer*

*Commissioner of Patents and Trademarks*